US005307826A

United States Patent [19]

Iosilevich

[11] Patent Number: 5,307,826

[45] Date of Patent: May 3, 1994

[54] AUTOMATIC MASCARA DISPENSING EYELASH CURLER

[75] Inventor: Irina Iosilevich, Ft. Lauderdale, Fla.

[73] Assignee: Ilya Iosilevich, Ft. Lauderdale, Fla.

[21] Appl. No.: 860,149

[22] Filed: Mar. 30, 1992

[51] Int. Cl.[5] ..... A45D 40/26

[52] U.S. Cl. ..... 132/218

[58] Field of Search ..... 132/320, 216, 217, 218; 401/9, 10; 15/27

[56] References Cited

U.S. PATENT DOCUMENTS

| | | | |
|---|---|---|---|
| 1,795,482 | 3/1931 | Ehmann | 132/218 |
| 2,444,937 | 7/1948 | Marcellus | 132/32 |
| 2,635,611 | 4/1953 | Marcellus | 132/32 |
| 2,788,537 | 4/1957 | Greenberg | 401/10 |
| 2,841,806 | 7/1958 | Blasi | 15/29 X |
| 3,016,059 | 1/1962 | Hutton | 132/32 |
| 3,104,783 | 9/1963 | Hall | 15/29 X |
| 4,458,701 | 7/1984 | Holland | 132/88.7 |
| 4,750,502 | 6/1988 | Ser et al. | 132/320 X |

*Primary Examiner*—Robert P. Swiatek
*Assistant Examiner*—Thomas Price
*Attorney, Agent, or Firm*—Frank L. Kubler

[57] ABSTRACT

An apparatus for applying fluid matter to eyelashes includes a member having an applicator surface for receiving fluid matter and transferring fluid matter onto an eyelash, a vessel structurally connected to the member for containing the fluid matter, a passageway extending from the vessel to the applicator surface, and a pump for pumping fluid matter from the vessel through the passageway to the applicator surface. The vessel is preferably contained within the member, and more specifically within a void within the member and the vessel is preferably a cartridge which can be removed from the void and replaced. The pump is preferably contained within the vessel. The vessel wall is preferably cylindrical, having two open ends, and having end walls which conform to and slidably fit within the vessel wall open ends, such that the end walls advance toward each other as fluid is pumped out of the middle of the vessel. A second member is preferably provided, also having an applicator surface, the second member being attached to the first member in a hinged relationship so that the applicator surfaces meet when the members are pivoted together. The applicator surfaces are preferably curved to conform to the curvature of a human eyelid and also curved to bend eyelashes gripped between the applicator surfaces into a curve. A bristled pad member is also provided, for removable attachment to an applicator surface. Each member preferably comprises a handle portion for holding and operating the apparatus.

23 Claims, 2 Drawing Sheets

AUTOMATIC MASCARA DISPENSING EYELASH CURLER

BACKGROUND OF THE INVENTION

1. Field of the Invention

The present invention relates generally to the field of devices for curling eyelashes, and more specifically to a combined eyelash curler and mascara applicator including a pair of elongate arm members having first and second ends, the first end of one arm member being pivotally joined to the first end of the other arm member, the second ends being resiliently spaced apart and each second end being fitted with a mascara brush, the mascara brushes having mating curved surfaces for gripping and curling an eyelash, one arm member containing a mascara delivery passageway and a replaceable mascara cartridge having a dispensing pump and a pump button directed toward the other arm member, such that pivoting the two arm members together depresses the pump button and dispenses a measured amount of mascara through the passageway onto the brushes and eyelash.

2. Description of the Prior Art

There have long been devices for curling and applying mascara to eyelashes. Holland, U.S. Pat. No. 4,458,701, issued on together at one end to form a V-shape. A mascara brush is attached to the other end of each handle member such that squeezing the members closes the brushes together. The brushes are each curved to fit easily upon the surfaces of the eyelashes and can simultaneously apply mascara and curl an eyelash gripped between them. A matching storage case containing mascara is provided. A problem with Holland is that one must dip the brushes into the case to re-coat them with mascara. The mascara in the case can spill, harden in the case or become contaminated with bacteria. Another problem is that the amount of mascara which happens to cling to the brushes when they are dipped into the case is not necessarily the proper quantity for an application. Finally, the case cannot be conveniently refilled with mascara.

Marcellus, U.S. Pat. No. 2,635,611, issued on Apr. 21, 1953, discloses an eyelash curler and mascara applicator. The Marcellus device teaches a pair of hinged linkages which operate jaws made up of a sliding plate which abuts edge to edge with a fixed plate. A brush laden with mascara is mounted so that its bristles extend essentially perpendicular to the plates near their abutting edges. An eyelash is inserted between the plates, the brush deposits mascara and the plates are closed together onto the eyelash. Then the eyelash is pulled through the plates, spreading the mascara and curling the eyelash. A problem with Marcellus is, once again, that the brush must periodically be dipped in mascara. This is inconvenient and requires that a separate mascara container be available. In addition, the amount of mascara which happens to stick to the brush is random rather than measured. Moreover, since the mascara is not stored in a vacuum sealed container, it can become infected with bacteria. Finally, Marcellus has numerous separate parts, making it complicated, costly, and susceptible to failure.

Hutton, U.S. Pat. No. 3,016,059, issued on Jan. 9, 1962, discloses a linkage apparatus similar to that of Marcellus for simultaneously curling and treating eyelashes. Pivoting linkage members operate jaws made up of two pads, shaped to follow the curvature of the eyelid. The pads are covered with mascara and have abutting faces which bend eyelashes gripped between them upward to effect a curl. Hutton shares the problems presented by Marcellus.

An earlier version of Marcellus, U.S. Pat. No. 2,444,937, issued on Jul. 13, 1948, reveals essentially the same eyelash curler and mascara applicator as the above, later version. The brush of this earlier version rests against the length of a lower jaw, which is a resilient rubber tube. The problems presented are the same as those of the later Marcellus device.

Ehmann, U.S. Pat. No. 1,795,482, issued on Mar. 10, 1931, teaches an eyelash and eyebrow coloring device. Tongs are pivotally secured together, presenting finger loops at one end and eyelash gripping jaws at the other end. These jaws are soft rubber tubes, curved to conform to the curvature of the eyelid, onto which eyelash coloring matter is placed. Ehmann shares all of the problems identified above, in addition to the fact that it is not designed for curling the eyelashes, which must be done separately.

It is thus an object of the present invention to provide a combination eyelash coloring and curling apparatus integrally including a container of fluid matter for coloring.

It is another object of the present invention to provide such an apparatus which dispenses fluid matter automatically onto opposing brushes when the brushes are closed together around an eyelash.

It is still another object of the present invention to provide such an apparatus which dispenses the fluid matter in optimal measured amounts.

It is still another object of the present invention to provide such an apparatus which stores the fluid matter in a replaceable vessel which is air-tight to prevent bacteria from growing in the matter.

It is still another object of the present invention to provide such an apparatus having replaceable fluid matter application pads with bristles.

It is finally an object of the present invention to provide such an apparatus which is simple and reliable in design and inexpensive to manufacture.

SUMMARY OF THE INVENTION

The present invention accomplishes the above-stated objectives, as well as others, as may be determined by a fair reading and interpretation of the entire specification.

An apparatus is provided for applying fluid matter to eyelashes, including a member having an applicator surface for receiving fluid matter and transferring fluid matter onto an eyelash, a vessel structurally connected to the member for containing the fluid matter, a passageway extending from the vessel to the applicator surface, and a pump for pumping fluid matter from the vessel through the passageway to the applicator surface. The vessel is preferably contained within the member, and more specifically within a void within the member and the vessel is preferably a cartridge which can be removed from the void and replaced. The pump is preferably contained within the vessel. The vessel includes a vessel wall and the pump preferably includes a chamber within the vessel having a chamber wall, wherein the chamber wall has an entrance port in fluid communication with the vessel and fitted with a check valve which permits fluid to enter but not to exit the chamber, and has an exit port fitted with a check valve which permits fluids to exit but not to enter the chamber, the exit port extending through the chamber wall and through the vessel wall and being in fluid communication with the passageway, the interior of the chamber wall comprising parallel wall surfaces and the chamber containing a piston having a stem portion which extends longitudinally through a hole in the vessel wall, and a piston head which extends laterally to meet in sliding relationship the parallel wall surfaces, such that depressing the stem portion of the piston extending through the hole in the vessel wall and thereby advancing the piston into the chamber forces fluid matter contained within the chamber through the exit port, and such that pushing the piston toward the hole and thereby advancing the stem portion through the hole and out of the chamber, causes fluid matter contained within the vessel to enter the chamber through the entrance port. The pump preferably includes a biasing mechanism for biasing the piston head toward the hole in the vessel wall. The vessel wall is preferably cylindrical, having two open ends, and having end walls which conform to and slidably fit within the vessel wall open ends. A second member is preferably provided, also having an applicator surface, the second member being attached to the first member in a hinged relationship so that the applicator surfaces meet when the members are pivoted together. The applicator surfaces are preferably curved to conform to the curvature of a human eyelid and also curved to bend eyelashes gripped between the applicator surfaces into a curve. A pad member is also provided having numerous perpendicularly extending bristles, for removable and replaceable attachment to an applicator surface. Each member preferably includes a handle portion for holding and operating the apparatus.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
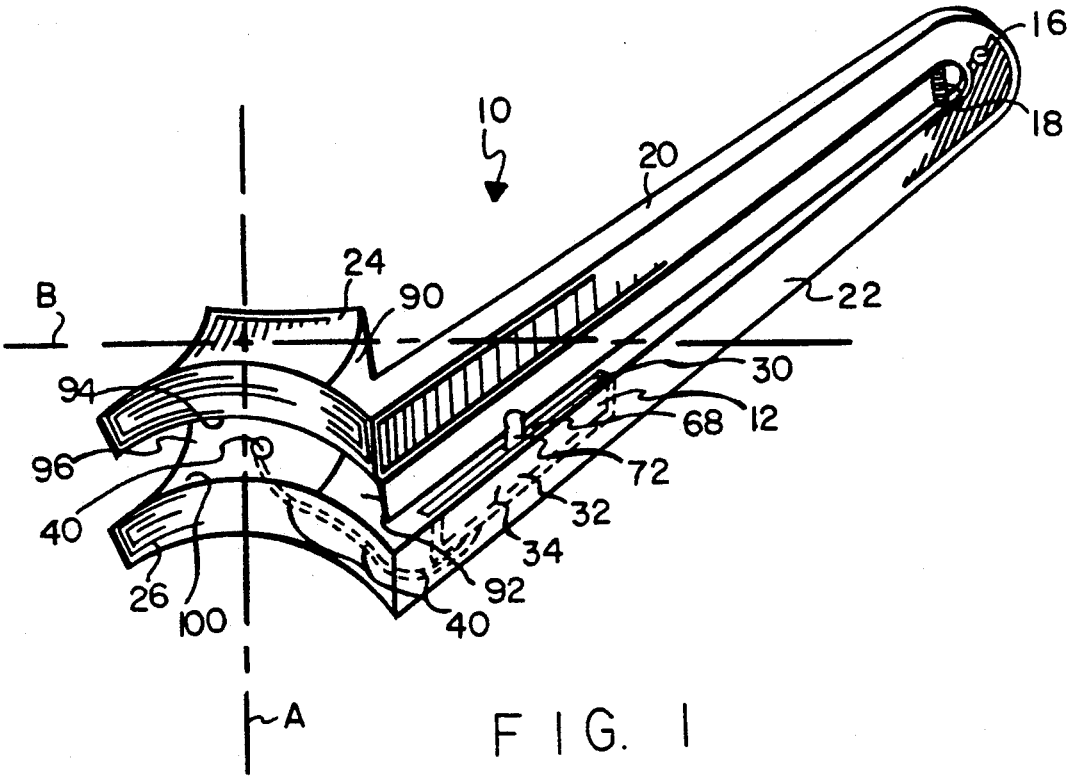
FIG. 1 is a perspective view of the first embodiment of the inventive eyelash curler and mascara applicator, showing the compartment, cartridge and passageway in broken lines.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIG. 1, an apparatus 10 for simultaneously curling and dispensing mascara or other fluid matter 12 onto eyelashes 14 is disclosed. Apparatus 10 includes two arm members 20 and 22, each having a first end and a second end, the first end of one arm member being pivotally joined to the first end of the other arm member with a hinge pin 16. The second ends of arm members 20 and 22 are resiliently spaced apart by a spring 18 and each second end is fitted with a brush assembly, 24 and 26, respectively. A compartment 30 is recessed into arm member 22 and receives a replaceable cartridge 32 for containing fluid matter 12.

Figure 2:
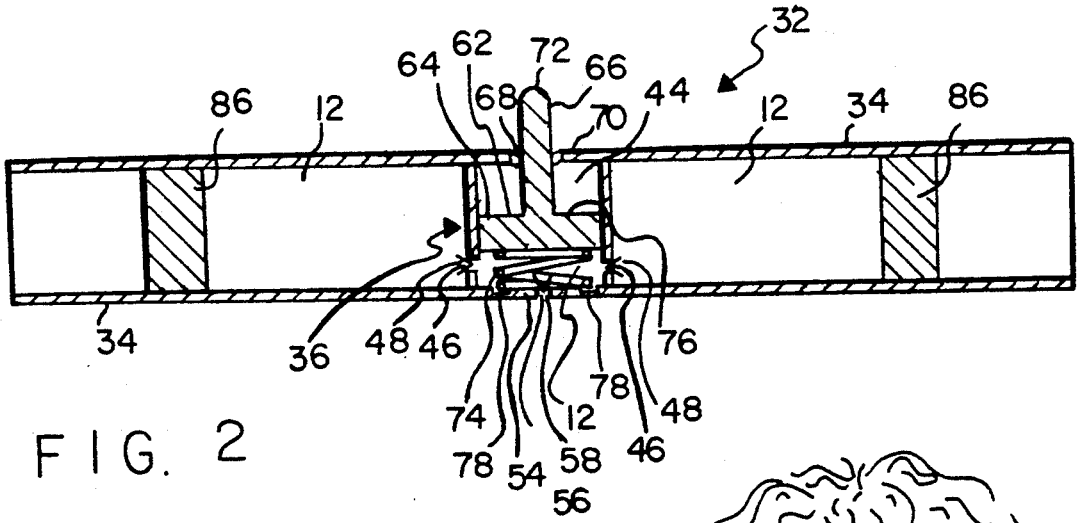
FIG. 2 is a cross-sectional side view of a replaceable mascara cartridge and its internal pump mechanism.

Cartridge 32 includes a cylindrical wall 34 and a fluid dispensing pump 36 which is activated by pivoting arm members 20 and 22 together. See FIG. 2. Pump 36 pushes a quantity of fluid matter 12 out of cartridge 32 and through a passageway 40 in arm member 22 to brush assembly 26.

Pump 36 preferably includes a cylindrical pump chamber 44 contained within cartridge 32 having two intake ports 46 opening between chamber 44 and the interior of cartridge 32. See FIG. 2. Each intake port 46 is fitted with a check valve 48 which permits fluid matter 12 to enter but not to exit pump chamber 44. At one end of cylindrical pump chamber 44 is a wall 54 common with cylindrical wall 34 of cartridge 32 and in this common wall 54 is an exit port 56. Exit port 56 opens into passageway 40 and is fitted with a check valve 58 permitting fluid matter 12 to pass out of but not into chamber 44. Opposite exit port 56 in chamber 44 is a piston 64 having a piston head 62 and a stem portion 66 which projects out of a hole 68 in a second wall 70 common to chamber 44 and cylindrical wall 34. Stem portion 66 forms a button 72 extending toward arm member 20. A coil type piston spring 74 biases piston 64 toward common wall 70 so that the shoulder portion 76 of piston 64 bears against the rim of hole 68. Piston spring 74 fits into a seat 78 recessed into common wall 54.

Squeezing arm members 20 and 22 together causes arm member 20 to bear against and depress button 72, pushing piston 64 through chamber 44 to common wall 54. Piston 64 forces all of the fluid matter 12 contained within chamber 44 out through exit port 56, through passageway 40 and onto brush assembly 26. Fluid matter 12 is also discharged onto brush assembly 24, since brush assembly 24 is pressed against brush assembly 26 at the moment the discharge of fluid matter 12 is completed. The interior volume of chamber 44 is selected during manufacture so that this volume, minus the volume of piston head 62 and piston spring 74, equals the optimum volume of fluid matter 12 to be dispensed onto an eyelash 14. In this way, a perfectly measured quantity of fluid matter 12 is discharged for each use of apparatus 10.

Releasing arm members 20 and 22 permits spring 18 to push them apart to their original position. As arm member 20 moves off and away from button 72, piston spring 74 pushes piston 64 back toward common wall 70 until shoulder portion 76 meets the rim of hole 68. As piston 64 moves toward common wall 70, a vacuum forms within chamber 44 and air pressure bearing against sliding end walls 86 forces fluid matter 12 through chamber intake ports 46 to completely refill chamber 44. End walls 86 therefore advance toward each other and toward chamber 44 as fluid matter 12 is depleted within cartridge 32. End walls 86 each form an air-tight seal within cylindrical wall 34 so that bacteria do not enter cartridge 32 and contaminate fluid matter 12. Where curling alone is desired, cartridge 32 can simply be removed from compartment 30 so that no fluid matter 12 is discharged during use.

Figure 3:
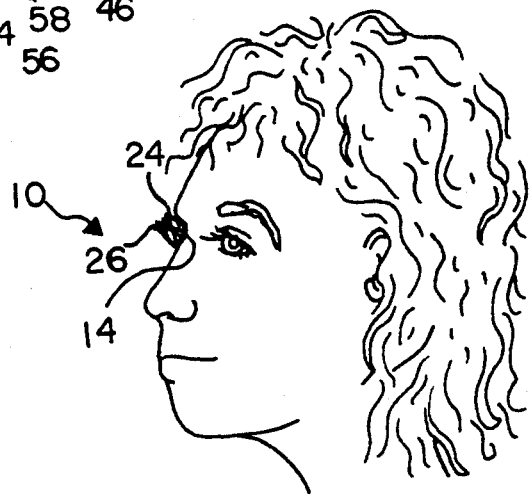
FIG. 3 is a side view of the top, forward portion of a person's head showing in cross-section the brush assemblies of the inventive apparatus closed around an eyelash.
Figure 4:
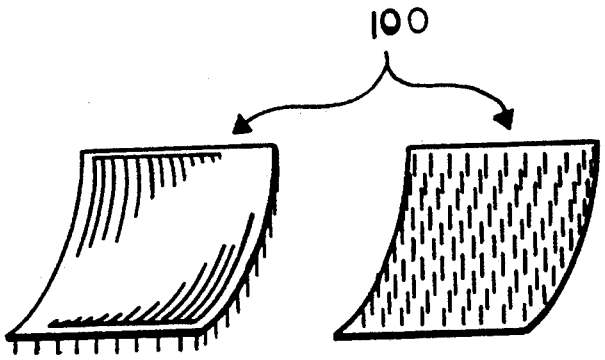
FIG. 4 is a perspective view of the front and back of a bristle pad for removably mounting on an arm member applicator surface.

Brush assemblies 24 and 26 are attached to handle member extenders 90 and 92 which are preferably angled away from the longitudinal axis of arm members 20 and 22, respectively, by approximately 45 degrees. See FIG. 1. This angling makes apparatus 10 easier to hold during use. Brush assemblies 24 and 26 each have a fluid matter 12 applicator surface 94 and 96, respectively. Applicator surfaces 94 and 96 are each curved about one axis A to follow the curvature of an average eyelid and about a second, perpendicular axis B to bend the eyelashes in a desired curve. The resulting applicator surface double curves approximate a quarter hyperboloid sheet, applicator surface 94 being convex and applicator surface 96 being concave, to permit surfaces 94 and 96 to mesh together. See FIGS. 1 and 3. Applicator surfaces 94 and 96 are sufficiently broad to cover an entire eyelash 14, so that curling and fluid matter 12 application can be accomplished in a single stroke. Brush assemblies 24 and 26 each preferably have a bristle pad 100, removably attached with an adhesive, which is replaced when worn, or needs to be cleaned or washed. See FIG. 4. The bristles on a pad 100 are very short and closely spaced together, so that pad 100 forms what may be termed a "microbrush." The fine bristles of pads 100 and the gradual curvature of applicator surfaces 94 and 96 make possible both curling and separation of individual eyelash 14 strands without breakage.

The term "fluid matter" as used in this specification and in the appended claims means any material which is capable of flowing, including liquids and gases.

Figure 6:
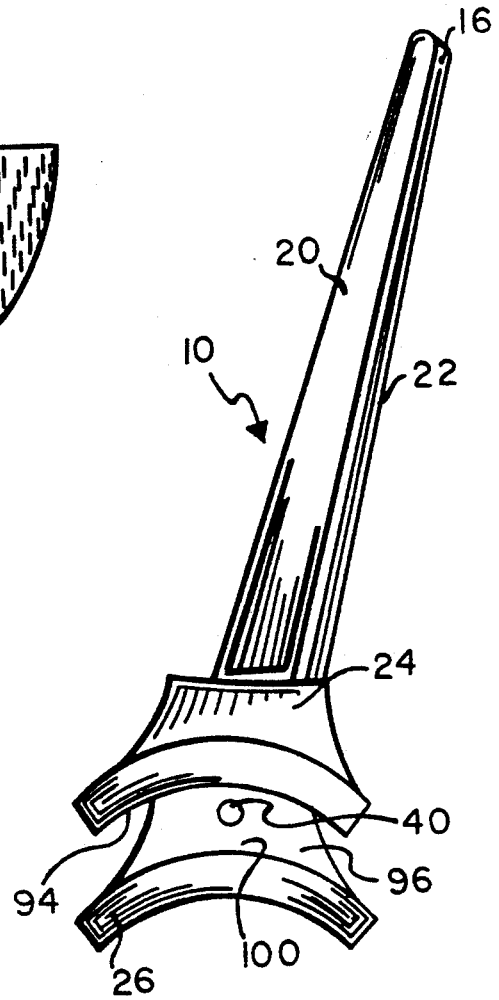
FIG. 6 is a perspective view of the preferred embodiment, having arm members directed backward from the brush assemblies.
Figure 5:
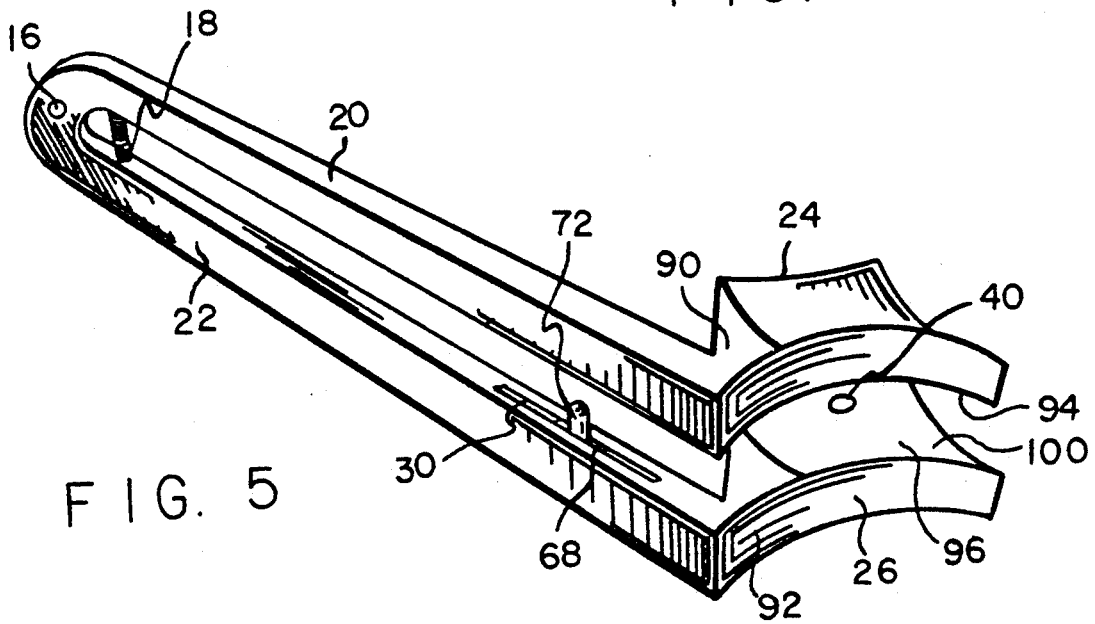
FIG. 5 is a perspective view of the preferred embodiment, having left handed arm members.

The above embodiment is preferably formed of either plastic or metal, or a combination of the two. This preference is not to be construed as limiting, however, and the use of other materials is contemplated. Arm members 20 and 22 shown in FIG. 1 extend to the right for right-handed use. It is also contemplated that these arm members may extend to the left, as shown in FIG. 5, for left-handed use, or straight back from brush assemblies 24 and 26, as shown in FIG. 6, for left- or right-handed use.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An apparatus for applying fluid matter to eyelashes, comprising:

a member having an applicator surface for receiving fluid matter and transferring fluid matter onto an eyelash, a vessel structurally connected to said member for containing said fluid matter, a passageway extending from said vessel to said applicator surface, a second member also having an applicator surface, said second member being attached to said first member in a hinged relationship so that said applicator surfaces meet when said first and second embers are pivoted together, fluid pressure pump means for pumping said fluid matter from said vessel through said passageway to said applicator surfaces, said fluid pressure pump means being activated by pivoting said first and second members.

2. An apparatus according to claim 1, wherein said vessel is contained within said member.

3. An apparatus according to claim 2, wherein said vessel is contained within a void within said member and said vessel is a cartridge which can be removed form said void and replaced.

4. An apparatus according to claim 1, wherein said pump means is contained within said vessel.

5. An apparatus according to claim 3, wherein said pump means is contained within said cartridge.

6. An apparatus according to claim 4, wherein said vessel comprises a vessel wall and said pump means comprises a chamber within said vessel having a chamber wall, wherein said chamber wall has an entrance port in fluid communication with said vessel and fitted with a check valve which permits fluids to enter but not to exit said chamber, and has an exit port fitted with a check valve which permits fluids to exit but not to enter said chamber, said exit port extending through said chamber wall and through said vessel wall and being in fluid communication with said passageway, said interior of said chamber wall comprising parallel wall surfaces and said chamber containing a piston having a stem portion which extends longitudinally through a hole in said vessel wall, and a piston head which extends laterally to meet in sliding relationship said parallel wall surfaces, such that depressing said stem portion of said piston extending through said hole in said vessel wall and thereby advancing said piston into said chamber forces fluid matter contained within said chamber through said exit port, and such that pushing said piston toward said hole and thereby advancing said stem portion through said hole and out of said chamber causes fluid matter contained within said vessel to enter said chamber through said entrance port.

7. An apparatus according to claim 6, additionally comprising a biasing means for biasing said piston head toward said hole in said vessel wall.

8. An apparatus according to claim 6, wherein said vessel wall is cylindrical, having two open ends, and having end walls which conform to and slidably fit within said vessel wall open ends.

9. An apparatus according to claim 6, additionally comprising a second member having an applicator surface, said second member being attached to said first member in a hinged relationship so that said applicator surfaces meet and said piston is depressed toward said exit port by pressure from contact with said second member, when said members are pivoted together.

10. An apparatus according to claim 9, wherein said applicator surfaces are curved to conform to said curvature of a human eyelid and also curved to bend eyelashes gripped between said applicator surfaces into a curve.

11. An apparatus according to claim 10, additionally comprising a pad member having a plurality of perpendicularly extending bristles, for removable attachment to an applicator surface.

12. An apparatus according to claim 9, wherein said second member comprises a handle portion for holding and operating said apparatus.

13. An apparatus according to claim 1, additionally comprising a second member also having an applicator surface, said second member being attached to said first member in a hinged relationship so that said applicator surfaces meet when said members are pivoted together.

14. An apparatus according to claim 1, wherein said applicator surfaces are curved to conform to said curvature of a human eyelid and also curved to bend eyelashes gripped between said applicator surfaces into a curve.

15. An apparatus according to claim 14, additionally comprising a pad member having a plurality of perpendicularly extending bristles, for removable attachment to an applicator surface.

16. An apparatus according to claim 1, wherein said member comprises a handle portion for holding and operating said apparatus.

17. An apparatus for applying fluid matter to eyelashes, comprising:

a member having an applicator surface for receiving fluid matter and transferring fluid matter onto an eyelash, a vessel structurally connected to said member for containing said fluid matter, a passageway extending from said vessel to said applicator surface, fluid pressure pump means for pumping said fluid matter from said vessel through said passageway to said applicator surface, wherein said pump means is contained within said vessel, wherein said vessel comprises a vessel wall and said pump means comprises a chamber within said vessel having a chamber wall, wherein said chamber wall has an entrance port in fluid communication with said vessel and fitted with a check valve which permits fluids to enter but not to exit said chamber, and has an exit port fitted with a check valve which permits fluids to exit but not to enter said chamber, said exit port extending through said chamber wall and through said vessel wall and being in fluid communication with said passageway, said interior of said chamber wall comprising parallel wall surfaces and said chamber containing a piston having a stem portion which extends longitudinally through a hole in said vessel wall, and a piston head which extends laterally to meet in sliding relationship said parallel wall surfaces, such that depressing said stem portion of said piston extending through said hole in said vessel wall and thereby advancing said piston into said member forces fluid matter contained within said chamber through said exit port, sand such that pushing said piston toward said hole and thereby advancing said stem portion through said hole and out of said chamber causes fluid matter contained within said vessel to enter said chamber through said entrance port.

18. An apparatus according to claim 17, additionally comprising a biasing means for biasing said piston head toward said hole in said vessel wall.

19. An apparatus according to claim 17, wherein said vessel wall is cylindrical, having two open ends, and having end walls which conform to and slidably fit within said vessel wall open ends.

20. An apparatus according to claim 19, additionally comprising a second member having an applicator surface, said second member being attached to said first member in a hinged relationship so that said applicator surfaces meet and said piston is depressed toward said exit port by pressure from contact with said second member, when said members are pivoted together.

21. An apparatus according to claim 20, wherein said applicator surfaces are curved to conform to said curvature of a human eyelid and also curved to bend eyelashes gripped between said applicator surfaces into a curve.

22. An apparatus according to claim 20, additionally comprising a pad member having a plurality of perpendicularly extending bristles, for removable attachment to an applicator surface.

23. An apparatus according to claim 20, wherein said second member comprises a handle portion for holding and operating said apparatus.

* * * * *